United States Patent [19]

Blanchard

[11] Patent Number: 4,478,422

[45] Date of Patent: Oct. 23, 1984

[54] GOLF PRACTICING AID

[76] Inventor: Vernon F. Blanchard, 30765 River Crossing, Birmingham, Mich. 48010

[21] Appl. No.: 481,598

[22] Filed: Apr. 4, 1983

[51] Int. Cl.[3] ..... A63B 69/36

[52] U.S. Cl. ..... 273/187 R; 273/186 C

[58] Field of Search ..... 33/137 R; 273/187 R, 273/186 R, 186 C, DIG. 21, 32 H, 183 A; 434/252

[56] References Cited

U.S. PATENT DOCUMENTS

| | | | |
|---|---|---|---|
| 650,136 | 5/1900 | Runnette | 33/137 R |
| 759,313 | 5/1904 | Roe | 33/137 R |
| 909,668 | 1/1909 | Prier | 33/137 R |
| 1,448,505 | 3/1923 | Powers | 273/DIG. 21 |
| 2,025,519 | 12/1935 | Lingg | 273/DIG. 21 |
| 2,396,877 | 3/1946 | Peterson | 33/137 R |
| 3,166,327 | 1/1965 | Champion | 273/187 |
| 3,658,344 | 4/1972 | Kimble | 273/187 R |
| 3,708,174 | 1/1973 | Kamarauskas | 273/187 R |
| 3,784,208 | 1/1974 | Weygandt | 273/183 A |
| 3,899,179 | 8/1975 | Vlach | 273/183 A |
| 3,920,248 | 11/1975 | Medders | 273/187 R X |
| 4,146,231 | 3/1979 | Merkle et al. | 273/187 R |
| 4,248,431 | 2/1981 | Burnes | 273/187 R |
| 4,257,608 | 3/1981 | Funk | 273/187 R |
| 4,322,084 | 3/1982 | Reece et al. | 273/187 R |

*Primary Examiner*—George J. Marlo
*Attorney, Agent, or Firm*—Krass & Young

[57] ABSTRACT

A cord has a plurality of graduated segments. The ends of each segment are defined by eyelets through which tees may be inserted to secure the cord to the ground in a figure "4" configuration. The ball is placed within the confines of the triangular portion and its location is marked by a pair of clips. The segment of the triangular portion which corresponds to a hypotenuse includes graduations spaced further apart than the graduations of the segment forming the base of the triangular portion. The position of the golfer's feet in relationship to the ball are marked by another series of clips on the segments.

7 Claims, 3 Drawing Figures

GOLF PRACTICING AID

DESCRIPTION

TECHNICAL FIELD

This invention relates to athletic equipment and, more particularly, to a practice aid for golfers.

BACKGROUND ART

Golf can be one of the most enjoyable games ever invented. It can also be one of the most frustrating. Many a sunny afternoon has been spoiled for want of better accuracy with the woods, irons and putter.

What appears to be a very simple game actually is quite complex. There are so many variables that affect the accuracy of a shot that there is simply no substitute for practice. One of the most important fundamentals is the position of the golfer's feet with respect to the ball. The patent literature is filled with various schemes, too numerous to mention here, for aiding the golfer in improving his game.

The following is a nonexhaustive list of some of the prior art teaching aids: U.S. Pat. Nos. 3,920,248; 4,146,231; 4,248,431; 4,257,608; 4,322,084; 3,658,344; 3,708,174; 3,899,179; 3,784,208; and 3,166,327.

Unfortunately, many of them are relatively expensive to manufacture, are bulky, or simply are not very effective teaching tools.

SUMMARY OF THE INVENTION

The present invention consists generally of a cord having several graduated segments, each graduation marking preselected spaced intervals on the cord. The ends of each segment are secured to the ground so that each segment is stretched into a straight line, with some of the segments lying at a right angle with respect to other segments. Some means such as clips, beads or the like are provided and used to mark locations on the cord at preselected graduations.

In the preferred embodiment the cord is secured to the ground so that it looks like the numeral "4" when viewed from a particular angle. For practicing wood and iron shots the ball is placed within the confines of the triangular-shaped portion and the position of the ball is marked with clips. One segment is aligned with the desired line of the flight of shot and the golfer stands behind this segment. Other clips are used to mark the lateral position of the golfer's feet with respect to the ball while a clip on a transversely extending segment marks the spacing between golfer's feet and the ball.

When practicing putting, the clips can be used to mark the extent of the backswing.

BRIEF DESCRIPTION OF THE DRAWINGS

The various advantages of the present invention will become apparent to those skilled in this art upon reading the following specification and by reference to the drawings in which.

DESCRIPTION OF THE PREFERRED EMBODIMENT

Figure 1:
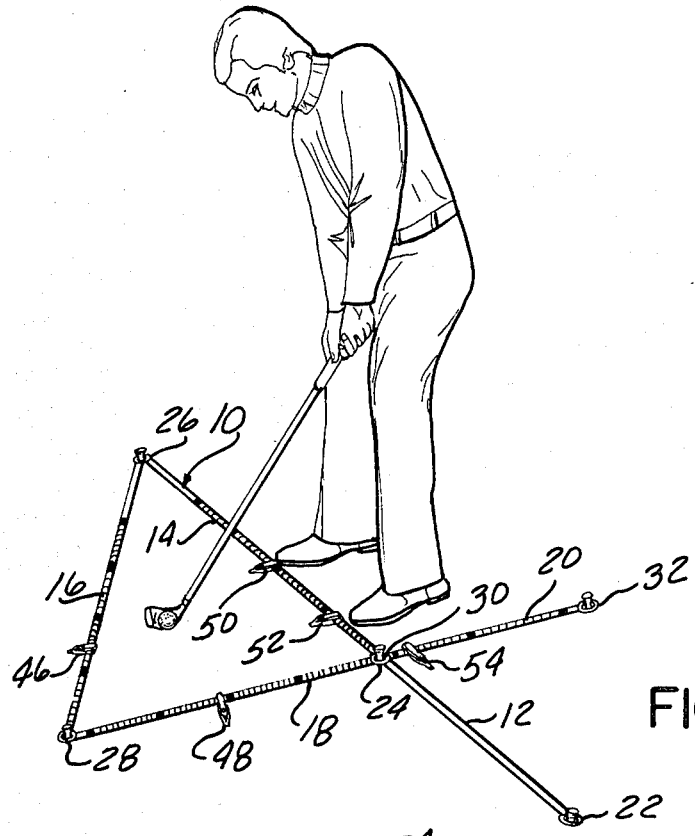
FIG. 1 is a perspective view showing a golfer practicing an iron shot using the practice aid of the preferred embodiment of the present invention.

The preferred, but not exclusive, embodiment of this invention takes the form of a string or cord generally designated by the numeral 10. Cord 10 is divided into a plurality of different segments 12–20. The ends of each segment are defined by some suitable means for securing the cord to the ground and form the segments into generally straight or linear lines. Advantageously, this is accomplished by way of eyelets 22 –32 through which conventional golf tees 34 may pass.

To use the practice aid of the present invention to practice wood or iron shots, the golfer places a tee 34 through eyelet 22. He then grasps the middle portions of cord 10 near eyelet 26 and stretches the cord until segments 12 and 14 are in a straight line defining the desired line of flight of the shot to be made. Then the golfer secures the end of segment 14 to the ground by passing a tee through eyelet 26. Eyelet 30 is then found and a tee is passed through both of eyelets 24 (between segments 12 and 14) and eyelet 30 (between segments 18 and 20). The golfer then grasps eyelet 28, pulling segment 16 and 18 taught and secures eyelet 28 to the ground with another golf tee. The lengths of each segment are chosen so that this procedure performs a right triangle circumscribing sufficient space to give the golfer a good deal of latitude to place a golf ball therein at a variety of different positions. Completing the set up procedure, eyelet 32 is grasped and segment 20 pulled taught and secured to the ground in line with segment 18.

Figure 2:
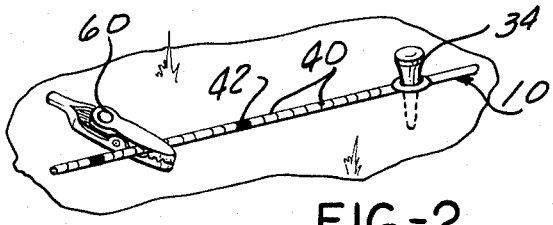
FIG. 2 is an enlarged view of a portion of the practice aid.

This procedure configures cord 10 into a shape which generally resembles the numeral 4 as viewed from the angle shown in FIG. 1. In the preferred embodiment, segments 14–20 are graduated in one inch increments. As can be seen most clearly in FIG. 2, each one inch increment is marked with color coded stripes. For example, the first five of the stripes 40 may be black whereas each sixth stripe 42 may be red to aid the golfer in visualizing each six inch spacing. It should be noted that the distance between each stripe on hypotenuse 16 is not exactly one inch but is somewhat longer so that each stripe corresponds in distance to an associated stripe on segment 14. This is because the golfer uses segment 14 as a base and the graduations on the hypotenuse segment 16 should be visually in line with the corresponding stripes on segment 14.

After the golf ball has been positioned within the triangle, the golfer then takes his stance with the outside of his left foot adjacent to segment 20 and with his toes pointing towards segment 14 as shown in FIG. 1. For best results the toes should be fairly close to segment 14. Clips 50 and 52 are used to mark the positions of the insteps of the golfer's right and left foot, respectively. Clip 54 is used to mark the distance that the golfer's toes are away from base segment 14. Clip 46 is then attached to segment 16 to a point where it marks the intersection of a straight line formed between the golfer and the golf ball. Then, clip 48 is moved along segment 18 until it is in line with the ball thereby marking the approximate spacing between the golfer and the golf ball.

The golfer is then ready to make a few practice shots. The golfer will note the accuracy of the shots with respect to the desired line of flight defined by segments 12 and 14. If the practice shots are not on line or if the golfer is not achieving the results that he wishes, the golfer then will change his stance relative to the ball and move the clips to new positions marking his new stance. This procedure is repeated until the best results are obtained.

When good results are obtained the golfer can mentally note the distance coordinates defining the spatial relationship between the golfer's stance and the ball, as well as the position of his body in relationship to the desired line of flight for use in an actual game. The golfer will know that his feet should be X inches apart by noting the distances between clips 50 and 52. The lateral position of the ball within the golfer's stance is noted by remembering the position of clip 46. The distance away from the golfer that the ball should be located is marked by the position of clip 48. An open or closed stance is noted by the golfer remembering the position of clip 54.

Figure 3:
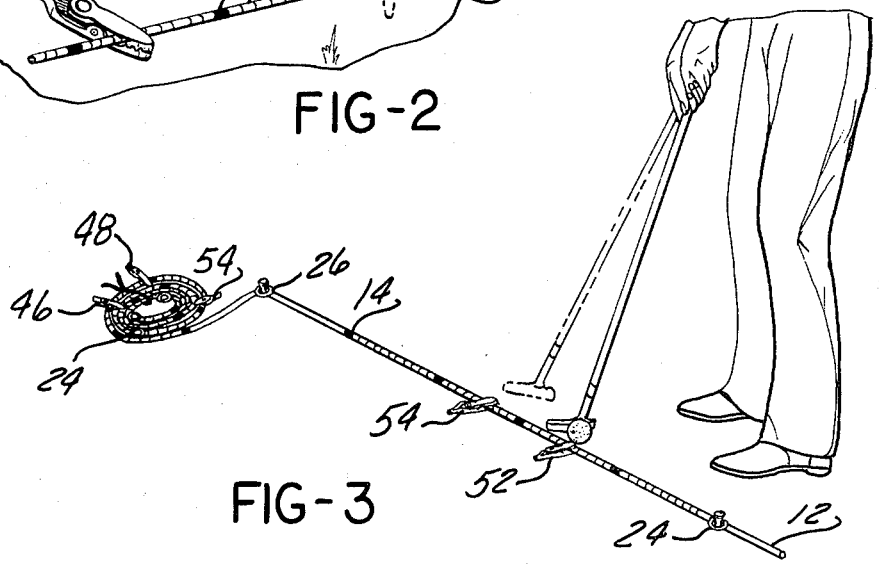
FIG. 3 is a perspective view showing the practice aid used in connection with putting.

The practice aid can also be used to practice putting. As shown in FIG. 3, cord segments 16–20 are removed leaving segments 12 and 14 to define the line of flight of a ball to be putted. The ball may be placed at any desired location. For example it may be placed next to eyelet 24 or if desired, placed near one of the clips such as clip 52. Another clip 54 may be placed on the graduated cord segment 14 to define the extent of the backstroke during putting. For example, the golfer may note that a 12 inch backstroke will result in a put travelling X feet, a backstroke of six inches resulting in a put travelling Y feet, etc. Still other uses of the practicing aid of this invention will undoubtedly come to the mind of the average and perhaps not so average golfer.

One of the primary advantages of the practice aid of this invention is that it is fairly easy and inexpensive to manufacture. It is also very compact and lightweight. After finally ironing out the problems with his swing, the cord may be rolled up and stuffed into the golf bag leaving the clips in their position at which the good results were achieved. This way, the cord can be used in warming up for the next round, with the clips defining the stance criteria that provided the best results in earlier practice sessions. If desired, the clips may include indicia or color coded buttons 60 thereon to remind the golfer where the particular clips should be used.

Again, it should be realized that the embodiment of the invention just described should not be construed as a limiting example since other modifications become apparent to those skilled in the art after a study of the specification, drawings and claims.

I claim:

1. A practice aid for a golfer comprising a length of cord having a plurality of segments including:

a base segment having graduations at intervals of a first preselected length, the base segment being of sufficient length to allow a golfer to take his stance adjacent thereto, first and second anchoring means fixedly secured at each end respectively of the base segment, the first and second anchoring means each having an eyelet adapted to receive the shank portion of a golf tee;

a reference segment fixedly secured at its first end to the second anchoring means, the reference segment having graduations at intervals of a second preselected length, the second length being greater than the first length;

third anchoring means fixedly secured at the second end of the reference segment, the third anchoring means having an eyelet adapted to receive the shank portion of a golf tee;

a foot gauge segment fixedly secured at its first end to the third anchoring means, the foot gauge segment having graduations at intervals of a first preselected length; and fourth anchoring means fixedly secured at the second end of the foot gauge segment, the fourth anchoring means having an eyelet adapted to receive the shank portion of a golf tee;

whereby, the golf aid device may be secured to the ground to form a configuration resembling a right triangle defining an area to place a golf ball therein, the reference segment being the hypotenuse of the right triangle so formed.

2. The practice aid of claim 1 wherein the graduations on the reference segment are located at points corresponding to the intersection of the reference segment and perpendicular lines drawn from the graduations on the base segment.

3. The practice aid of claim 8 including:

a first terminal segment fixedly secured at its first end to the first anchoring means;

a second terminal segment fixedly secured at its first end to the fourth anchoring means; and fifth and sixth anchoring means fixedly secured at each of the second ends respectively of the first and second terminal segments, the fifth and sixth anchoring means each having an eyelet adapted to receive the shank portion of a golf tee, whereby, the golf aid device may be secured to the ground to form a configuration resembling the numeral 4, with the base, foot gauge, and reference segments forming a right triangle defining an area to place a golf ball therein, the reference segment being the hypotenuse of the right triangle so formed.

4. The practice aid of claim 1 including means for marking locations on the cord associated with the position of the golfer's stance relative to the golf ball.

5. The practice aid of claim 4 wherein said marking means are clips.

6. A method for improving the accuracy of a golf shot including the steps of:

securing a cord having a plurality of graduated segments to the ground to form a configuration resembling the numeral 4, with three of the adjacent segments forming a right triangle;

taking a hitting stance adjacent a base segment of the triangle;

placing a golf ball within the triangular area defined by the cord segments;

noting the distance between the golf ball and the golfer's feet by referring to the graduations on the cord segments;

hitting the golf ball; and adjusting the position of the ball relative to the golfer's feet on subsequent shots until the ball travels in the desired direction.

7. The method of claim 6 including positioning marking means on the cord segments to indicate the locations of the golf ball and the golfer's feet for a particular shot.

* * * * *

UNITED STATES PATENT AND TRADEMARK OFFICE

CERTIFICATE OF CORRECTION

PATENT NO. : 4,478,422

DATED : October 23, 1984

INVENTOR(S) : Vernon F. Blanchard

It is certified that error appears in the above-identified patent and that said Letters Patent are hereby corrected as shown below:

Column 4, line 23, Claim 3, delete "the practice aid of Claim 8" and insert --the practice aid of Claim 2--.

Signed and Sealed this

*Twenty-fifth* Day of *June 1985*

[SEAL]

*Attest:*

DONALD J. QUIGG

*Attesting Officer*

*Acting Commissioner of Patents and Trademarks*